US009193208B2

(12) United States Patent
Chung et al.

(10) Patent No.: US 9,193,208 B2
(45) Date of Patent: Nov. 24, 2015

(54) RECORDING MATERIAL

(75) Inventors: Chao-Jen Chung, North Wales, PA (US); Lan Deng, Pittsburgh, PA (US); Brian R. Einsla, Chalfont, PA (US); Michael Horn, Offenburg (DE); Juergen Keske, Neurled (DE); Douglas Rudnick, North Wales, PA (US)

(73) Assignees: Rohm and Haas Company, Philadelphia, PA (US); Papierfabrik August Koehler AG, Oberkirch (DE)

( * ) Notice: Subject to any disclaimer, the term of this patent is extended or adjusted under 35 U.S.C. 154(b) by 113 days.

(21) Appl. No.: 14/112,826

(22) PCT Filed: Apr. 19, 2012

(86) PCT No.: PCT/US2012/034166

§ 371 (c)(1),
(2), (4) Date: Oct. 18, 2013

(87) PCT Pub. No.: WO2012/145456

PCT Pub. Date: Oct. 26, 2012

(65) Prior Publication Data

US 2014/0037901 A1 Feb. 6, 2014

Related U.S. Application Data

(60) Provisional application No. 61/477,372, filed on Apr. 20, 2011.

(51) Int. Cl.

| | |
|---|---|
| ***B41M 5/124*** | (2006.01) |
| ***B41M 5/36*** | (2006.01) |
| ***B41M 5/52*** | (2006.01) |

(52) U.S. Cl.

CPC ..... *B41M 5/52* (2013.01); *B41M 5/124* (2013.01); *B41M 5/366* (2013.01); *Y10T 428/2438* (2015.01); *Y10T 428/249972* (2015.04)

(58) Field of Classification Search

CPC ..... B41M 5/124; B41M 5/36; B41M 5/366; Y10T 428/24372; Y10T 428/2438; Y10T 428/24893; Y10T 428/24901

USPC ..... 428/313.5

See application file for complete search history.

(56) References Cited

U.S. PATENT DOCUMENTS

| | | | |
|---|---|---|---|
| 2,519,660 | A | 8/1950 | James |
| 3,031,328 | A | 4/1962 | Larsen |
| 3,306,763 | A | 2/1967 | Hoge |
| 3,347,675 | A | 10/1967 | Henn et al. |
| 3,348,776 | A | 10/1967 | Hunter |
| 3,684,551 | A | 8/1972 | Seiner |
| 4,427,835 | A | 1/1984 | Bush et al. |
| 4,428,321 | A | 1/1984 | Arens |
| 4,469,825 | A | 9/1984 | Kowalski et al. |
| 4,480,842 | A | 11/1984 | Mahyera et al. |
| 4,594,363 | A | 6/1986 | Blankenship et al. |
| 4,920,160 | A | 4/1990 | Chip et al. |
| 4,985,064 | A | 1/1991 | Redlich et al. |
| 5,036,109 | A | 7/1991 | Chip et al. |
| 5,041,484 | A | 8/1991 | Atwell et al. |
| 5,157,084 | A | 10/1992 | Lee et al. |
| 5,378,534 | A | 1/1995 | Kuroanagi et al. |
| 5,409,776 | A | 4/1995 | Someya et al. |
| 5,470,688 | A | 11/1995 | Texter et al. |
| 5,494,971 | A | 2/1996 | Blankenship |
| 5,510,422 | A | 4/1996 | Blankenship et al. |
| 6,043,193 | A | 3/2000 | Chen et al. |
| 6,139,961 | A | 10/2000 | Blankenship et al. |
| 6,252,004 | B1 | 6/2001 | Blankenship et al. |
| 6,372,819 | B1 | 4/2002 | Mizobuchi et al. |
| 6,632,531 | B2 | 10/2003 | Blankenship |
| 6,896,905 | B2 | 5/2005 | Blankenship et al. |
| 7,507,453 | B2 | 3/2009 | Geddes et al. |
| 7,935,656 | B2 | 5/2011 | Elmasry et al. |
| 8,054,323 | B2 | 11/2011 | Peters et al. |
| 2003/0176535 | A1 | 9/2003 | Chung et al. |
| 2007/0104081 | A1 | 5/2007 | Moronuki et al. |
| 2008/0058207 | A1 | 3/2008 | Ohga |
| 2008/0182749 | A1 | 7/2008 | Tohmatsu et al. |
| 2011/0251060 | A1 | 10/2011 | Harrison et al. |

FOREIGN PATENT DOCUMENTS

| | | | |
|---|---|---|---|
| EP | 0072065 | A2 | 2/1983 |
| EP | 267726 | A2 | 5/1988 |
| EP | 331421 | A2 | 9/1989 |
| EP | 915108 | A1 | 5/1999 |
| JP | 02080288 | | 3/1990 |
| JP | 06305251 | | 1/1994 |
| JP | 06092035 | | 5/1994 |
| JP | 03176961 | B2 | 6/2001 |

OTHER PUBLICATIONS

Wiley, John and Sons, NC.; Journal of Polymer Science—Part A, vol. 39, pp. 1435-1449 (2001).

*Primary Examiner* — Bruce H Hess

(74) *Attorney, Agent, or Firm* — Karl E. Stauss; Ronald D. Bakule

(57) ABSTRACT

A recording material including a support and disposed thereon at least one layer including certain core/shell polymeric particles, the particles having, whey dry, at least one void; and an opacity reducer is provided. A method for providing an image using the recording sheet is also provided.

8 Claims, No Drawings

RECORDING MATERIAL

This invention relates to a recording material. More specifically, this invention relates to a recording material including: a) a support having at least one colored surface; and, disposed thereon, b) a layer including certain polymeric particles having a core/shell structure, the particles including, when dry, at least one void; and an opacity reducer. This invention also relates to a recording material including: a) a support; and, disposed thereon, b) a layer including a permanent colorant, certain polymeric particles having a core/shell structure, the particles including, when dry, at least one void; and an opacity reducer. This invention also relates to a method of providing an image using the recoding materials.

Recording materials such as, for example, recording sheets that are used to provide an image are well-known in the art. The development of an image by exposing selected portions of a recording sheet to energy such as, for example, to heat, pressure, light, ultrasonic radiation, or combinations thereof has been widely practiced. The formation of an image using the recording material of the present invention is typically effected through the use of heat, pressure, or combinations thereof.

US Patent Application Publication No. 2008/0058207 discloses a recording material comprising a heat sensitive recording layer provided on a support and having a hollow particle and a heat sensitive coloring component. The heat sensitive coloring component contains an electron-donating dye precursor, an electron-accepting compound, and a sensitizer.

U.S. Pat. No. 5,378,534 discloses a recording sheet formed by coating colored sheets with an opacifying compound prepared by mixing an aqueous suspension of polymer particles embodying internal voids dispersed with a water base coating material.

Improvements in the performance of recording materials are still sought. The present invention provides simplicity of formulations and versatility in the methods and types of images that can be formed without the frequently expensive methods based on the reaction of color precursors and developer, which are inherently subject to long term instability.

In a first aspect of the present invention there is provided a recording material comprising: a) a support comprising at least one colored surface; and, disposed thereon, b) a layer comprising polymeric particles having a core/shell structure, said particles selected from the group consisting of: (i) particles having an outer polymer shell having a calculated Tg of from 40° C. to 130° C.; said particles comprising, when dry, at least one void; and from 1% to 90%, by weight based on the weight of said polymer particles, opacity reducer having a melting point of from 45° C. to 200° C.

In a second aspect of the present invention there is provided a recording material comprising: a) a support; and, disposed thereon, b) a layer comprising a permanent colorant and polymeric particles having a core/shell structure, said particles having an outer first polymer shell having a calculated Tg of from 40° C. to 130° C., said particles comprising, when dry, at least one void; and from 1% to 90%, by weight based on the weight of said polymer particles, opacity reducer having a melting point of from 45° C. to 200° C.

In a third aspect of the present invention there is provided a method for providing an image comprising: forming the recording material of the first or second aspects of the present invention; and subjecting selected portions of said recording material to a physical agent selected from the group consisting of heat, pressure, and combinations thereof, sufficient to reduce the opacity of said selected portions.

The recording material of the present invention includes a support. Typically, the support will be in the form of a sheet-like structure such as, for example, paper, synthetic paper, board, plastic film such as vinyl or polyester, leather, wood veneer, metal, and nonwoven sheet. In certain aspects of this invention the support has one colored surface, although both sides may be colored. By "colored surface" herein is meant that the surface has sufficient color density to be visibly contrasting to the surface of the subsequent layer disposed thereon; The color may be imparted, for example, by pigments, dyes, or the intrinsic color of the support and the support may be impregnated with colorant or coated with a colored coating to provide a colored surface. The colored surface may be uniform or varied in color density or may be patterned as desired.

The recording material of this invention includes a layer that includes certain polymeric particles having a core/shell structure, the particles including, when dry, at least one void. Various of the polymeric particles that have a core/shell structure, the particles including, when dry, one or more voids include ROPAQUE™ opaque polymer and hollow polymer particles, as disclosed in U.S. Pat. Nos. 4,427,835; 4,920,160; 4,594,363; 4,469,825; 4,468,498; 4,880,842; 4,985,064; 5,157,084; 5,041,464; 5,036,109; 5,409,776; 5,510,422; 5,494,971; 5,510,422; 6,139,961; 6,632,531; and 6,896,905; European Patent Applications EP 267,726, EP 331,421 and EP 915,108; and Journal of Polymer Science—Part A, volume 39, pages 1435-1449 (2001), published by John Wiley and Sons, Inc. The polymer particles may be made by emulsion polymerization.

The core of the core-shell polymeric particle includes, when dry, at least one void capable of scattering visible light, i.e., capable of providing opacity to a composition in which it is included. Core-shell particles including, when dry, one or more void have been disclosed in which the void was generated, for example, by complete or partial hydrolysis and dissolution of the core polymer, by swelling of the core polymer with acid, base or nonionic organic agents with restricted subsequent collapse of the particle, and the like. In a preferred embodiment the core-shell particle is formed by an aqueous multistage emulsion polymerization followed by swelling with a base.

The stages of the multistage polymers employed in the present invention include a core polymer, a first shell polymer and, in some instances, a second shell polymer. The core and shells may each, independently, include more than one stage. There may also be one or more intermediate stages. An intermediate stage polymer, when present, partially or fully encapsulates the core and itself is partially or fully encapsulated by the first shell. The intermediate stage, referred to as a "tiecoat" herein, may be prepared by conducting an emulsion polymerization in the presence of the core. The first shell polymer partially or fully encapsulates the core polymer and, if present, the tiecoat polymer. In some embodiments the first shell polymer may be the outer shell. The outer second shell polymer, if present, partially or fully encapsulates the first shell. By "partially encapsulates" herein is meant that at least 50% of the surface area is covered with the subsequent polymer.

The polymeric particles may be polymerized using a variety of ethylenically unsaturated monomers as described in the above references. Examples of nonionic monoethylenically unsaturated monomers include styrene, vinyltoluene, ethylene, vinyl acetate, vinyl chloride, vinylidene chloride, acrylonitrile, (meth)acrylamide, various ($C_1$-$C_{20}$) alkyl or ($C_3$-$C_{20}$) alkenyl esters of (meth)acrylic acid, including methyl acrylate (MA), methyl methacrylate (MMA), ethyl (meth)

acrylate, butyl (meth)acrylate, 2-hydroxyethyl (meth)acrylate, 2-ethylhexyl (meth)acrylate, benzyl (meth)acrylate, lauryl (meth)acrylate, oleyl (meth)acrylate, palmityl (meth) acrylate, and stearyl (meth)acrylate. The expression (meth) acrylic acid includes both acrylic acid and methacrylic acid. The use of the term "(meth)" followed by another term such as (meth)acrylate or (meth)acrylamide, as used throughout the disclosure, refers to both acrylates or acrylamides and methacrylates and methacrylamides, respectively. Typically methyl methacrylate, ethyl acrylate, butyl acrylate and styrene are preferred monomers to polymerize and form the shell of the polymeric particles. Difunctional vinyl monomers, such as divinyl benzene, allyl methacrylate, ethylene glycol dimethacrylate, 1,3-butane-diol dimethacrylate, diethylene glycol dimethacrylate, trimethylol propane trimethacrylate, and the like, may also be copolymerized to form a crosslinked outer shell such as are taught in US Patent Application Publication No. 2003-0176535 A1.

The calculated glass transition temperature ("Tg") of the various shells of the polymeric particles is achieved by selection of the monomers and amounts of the monomers to achieve the desired polymer Tg as is well known in the art. Tgs of the polymers are calculated herein by using the Fox equation (T. G. Fox, Bull. Am. Physics Soc., Volume 1, Issue No. 3, page 123(1956)). that is, for calculating the Tg of a copolymer of monomers M1 and M2, $$1/Tg(\text{calc.})=w(M1)/Tg(M1)+w(M2)/Tg(M2),$$

wherein

Tg(calc.) is the glass transition temperature calculated for the copolymer w(M1) is the weight fraction of monomer M1 in the copolymer w(M2) is the weight fraction of monomer M2 in the copolymer Tg(M1) is the glass transition temperature of the homopolymer of M1

Tg(M2) is the glass transition temperature of the homopolymer of M2, all temperatures being in K.

The glass transition temperature of homopolymers may be found, for example, in "Polymer Handbook", edited by J. Brandrup and E. H. Immergut, Interscience Publishers. In embodiments where two or more different polymeric particles are used then the calculated Tg of a particular shell, for example, shall be calculated based on the overall composition of the shell polymers.

In one aspect the present invention relates to a recording material including a layer including a core/shell polymeric particle that includes a core and a first shell: the core including, when dry, at least one void; the first shell polymer having a calculated glass transition temperature ("Tg") of from 40° C. to 130° C., alternatively from 40° C. to 80° C.

In one aspect the present invention relates to a recording material including a layer including a core/shell polymeric particle that includes a core, a first shell, and a second shell: the core including, when dry, at least one void; the first shell polymer having a calculated glass transition temperature (Tg) of from 40° C. to 130° C.; and the second shell polymer having a Tg of from −55° C. to 50° C.; wherein the calculated Tg of the outer polymer shell is lower than that of the inner polymer shell; and wherein the weight ratio of the second shell polymer to the total of all other structures of the polymeric particle is from 0.15:1 to 3:1. The second shell polymer has a composition different from that of the first shell polymer. The first and second shell may be based on multiple stages, compositions, and be based on asymmetric monomer additions; the calculated Tg of the second shell is calculated based on the sum of all polymer formed after the first shell polymer is formed. By the "total of all other structures of the polymeric particle" herein is meant the total of optional seed polymer, the core polymer, the optional tie coat, and the first stage polymer, each optionally including a multiplicity of stages or compositions.

The polymeric particles having a core/shell structure used in this invention typically have an outer diameter of from 200 nm to 1500 nm, preferably from 250 nm to 1200 nm, and an inner (void) diameter of from 150 nm to 1000 nm, preferably from 200 nm to 800 nm. Recording materials of the present invention may include a blend of two or more hollow microsphere polymers having different cavity sizes.

The layer of the recording material of this invention that includes the polymeric particles having a core/shell structure also includes from 1% to 90%, preferably from 5% to 70%, and more preferably from 10% to 40%, by weight based on the weight of the polymeric particles, opacity reducer. The opacity reducer is an organic compound that exhibits a melting point of from 45° C. to 200° C., preferably from 55° C. to 175° C., and most preferably from 60° C. to 150° C.

Organic compounds which are solid below 45° C. but flow upon heating under a thermal printhead can be used as opacity reducers. These compounds have a melting point of from 45° C. to 200° C., preferably from 55° C. to 175° C., and most preferably from 60° C. to 150° C. Such organic compounds include, for example, aromatic oxalic acid esters, aromatic ethylene glycol ethers, 1,2-diphenyloxyethane, dibenzyl oxalate, dibenzyl terephthalate, benzyl-biphenyl, benzyl-2-naphthyl ether, diphenyl sulfone, m-terphenyl, p-benzyloxybenzyl benzoate, cyclohexane dimethanol benzoate, p-toluenesulfonamide, o-toluenesulfonamide, 2,6-diisopropyl naphthalene, 4,4-diisopropyl biphenyl, and waxes such as erucamide, stearic acid amide, palmitic acid amide, and ethylene-bis-stearic acid amide. The opacity reducers that are not water soluble are usually dispersed in water and typically have a particle diameter of from 50 nm to 5000 nm, preferably from 150 nm to 3000 nm, and most preferably from 200 nm to 1500 nm.

The layer of the recording material of this invention that includes the polymeric particles having a core/shell structure including, when dry, at least one void, may optionally include a polymeric binder. By "polymeric binder" herein is meant a polymer expressly excluding core/shell polymer particles including, when dry, a void. The polymeric binder may include particulate polymers such as, for example, emulsion polymers and soluble polymers such as are commonly known as resins. The polymeric binder may be present in an amount of from 0% to 40%, preferably from 0% to 30%, by weight based on the total dry weight of the polymeric binder and the polymeric core/shell particles including, when dry, a void. When the calculated Tg of the outer shell of the polymer particles having a core/shell structure including, when dry, a void is less than 50° C., it may not be necessary to use a polymeric binder, although it is optional to use a coalescent or plasticizer to facilitate film integrity.

The calculated glass transition temperature ("Tg") of the polymeric binder is typically from −65° C. to 105° C., or in the alternative, from −25° C. to 35° C. The weight average particle diameter of polymeric binder particles formed by emulsion polymerization is typically from 30 nm to 500 nm, preferably from 40 nm to 400 nm, and more preferably from 50 nm to 250 nm.

The polymeric binder be or may include resin(s) other than emulsion polymers, including, for example, thermoplastic and crosslinkable resins. Useful resin components include, for example, polyvinyl alcohol, protein such as, for example, casein, starch, gelatin, copolymers of acrylic acid esters or methacrylic acid esters, copolymers of styrene and acrylic or methacrylic acid esters, copolymers of styrene and acrylic acid, styrene-butadiene copolymers, copolymers of vinyl acetate with other acrylic or methacrylic acid esters, and the like.

The layer(s) of the present invention may be formulated in an aqueous medium, i.e., a medium including predominantly water, by blending in a conventional low shear mixing apparatus. Other well known mixing techniques may be employed to prepare the layers of the present invention.

Additives may be incorporated into the layer formulations to confer certain performance properties. The layer formulation may contain, in addition to the core/shell emulsion polymer, opacity reducer, and optional pigment(s) such as for example, calcium carbonate and silica, adjuvants such as, for example, emulsifiers, surfactants, lubricants, coalescing agents, plasticizers, antifreezes, curing agents, buffers, neutralizers, thickeners, rheology modifiers, humectants, wetting agents, biocides, plasticizers, antifoaming agents, UV absorbers, fluorescent brighteners, light or heat stabilizers, biocides, chelating agents, dispersants, colorants, water-repellants, and anti-oxidants. Typical bases that may be incorporated in layer formulations of the present invention include ammonia; fixed bases such as NaOH, KOH, and LiOH; amines such as diethanolamine, triethanolamine and any other known base to control pH. The layer is applied to the support by conventional coating means known in the art and dried, typically with the minimum heat for the minimum time to enable facile handling of the recording material, whether in separate sheet or in roll form, while avoiding premature collapse of the voids in the core/shell polymeric particles.

In one embodiment of this invention a support including at least one colored surface having a surface roughness of less than 3.0, alternatively from 0.5 to 3.0, alternatively from 0.5 to 2.5, microns as measured by a Parker print surf roughness tester is employed. The smoothness of this surface is important to high print quality.

In one embodiment of this invention a dual-color recording material is provided including (a) dark colorant layer (b) a layer including core/shell polymeric particles including, when dry, a void; an opacity reducer; and a light colorant with an optional binder layer on top; and (c) an optional layer of core/shell polymeric particles including, when dry, a void (and optional binder) on top. The dual-color recording material is white with the optional layer (c) on top. It is colored without the optional layer (c). The dual-color recording material is heat and/or pressure sensitive. Upon applying low heat or pressure, it shows vivid color of the top colorant. Upon applying higher heat or pressure, it shows vivid color of the bottom colorant.

In another aspect of this invention a support, that may or may not be colored, has disposed thereon a layer including certain core/shell particles, an opacity reducer, and a permanent colorant. By "permanent colorant" is meant herein a colorant such as, for example one or more dyes, pigments or mixtures thereof that produce a visible color that is substantially invariant during the application or drying of the layer, storage, and formation of an image using the recording material. Expressly excluded as permanent colorants are any material amounts of color precursors such as leuco dyes, for example, and developers such as bisphenols, for example, which form colorants during the application or drying of the layer, storage, or formation of an image using the recording material. Preferably the layer is substantially free from color precursors and developers. Typically less than 5%, preferably less than 1%, and more preferably less than 0.1%, total colorant precursors and developers, by weight based on the total weight of colorant in the layer are included. Alternatively, a recording material is contemplated including a support, that may or may not be colored, that has disposed thereon a layer including certain core/shell particles, an opacity reducer, and a permanent colorant; and, additionally, an optional layer of core/shell polymeric particles including, when dry, a void (and optional binder) on top.

In the method of this invention the recording material of one of the aspects of the invention is formed and selected portions of the recording material are subjected to heat, pressure, or combinations thereof such as are effected by direct thermal printing, for example. "Pressure" herein is understood to include methods that may cause distortion or removal of some or all of the layer as well as pressure applied substantially normal to the substrate.

The invention in some of its embodiments will now be further described by reference to the following examples:

Polymeric Particles Having a Core/Shell Structure.

Samples 1-3 were prepared according to the teachings of Example 17 of U.S. Pat. No. 6,252,004.

Sample 1 had an inner shell having a calculated Tg of 63.1° C. and an outer shell having a calculated Tg of −1.5° C. Sample 2 had an outer shell (single shell) having a calculated Tg of 100.7° C. Sample 3 had an inner shell having a calculated Tg of 64.6° C. and an outer shell having a calculated Tg of 6.1° C.

Equipment:

A4 cellulosic copy paper (ASPEN™ 30) as base substrate (support).

#18 and #22 WWR for hand drawdowns.

Printrex Atlantek Paper Tester Model 200 for thermal printing tests.

Surface Roughness Measurement:

The roughness of the support sheets is measured by a Parker print surface roughness tester (Model No. M590, Messmer Instruments Ltd.) using TAPPI official test Method T555. This method measures the air flow between the test surface and a metal band in contact with it. The rate of the air flow is related to the surface smoothness of the paper. An average of five measurements is recorded as the roughness of the specimen.

Particle Diameter Measurement

Particle sizes(diameters) herein are those determined using a Brookhaven BI-90 Plus particle size analyzer.

Determination of Melting Point

Melting points herein are those determined by differential scanning calorimetry using a TA instruments Q1000 V9.6 Build 290. The opacity reducer, which was in the form of an aqueous dispersion or solution, was placed in a differential scanning calorimetry pan and allowed to dry at room temperature for 72 hours. After that time the lid was crimped on the loaded pan. For melting points below 150° C., the opacity reducer samples were heated from ambient temperature to 150° C. at a rate of 20° C./min, held for 5 minutes, then equilibrated at −90° C., held for 2 minutes, and heated to 150° C. at a rate of 20° C./min; readings were taken from the second heating cycle.

TABLE I

| Chemical composition and melting points of opacity reducers | | | |
|---|---|---|---|
| Sample | Description | Composition | Melting Point (° C.) |
| KS-235 | Organic compound | 1,2 Diphenyloxy-ethane | 101.85 |
| Crodamide ™SVF | Organic compound | Stearamide | 110.60 |
| HS-2046 | Organic compound | Dibenzyl Oxalate | 87.71 |
| BON | Organic compound | Benzyl-2-Napthyl ether | 101.71 |
| TMP | Organic Compound | Trimethylol-propane | 57.66 |

EXAMPLE 1

Preparation and Evaluation of Layer of Recording Material Including Opacity Reducers Layer Formulation 1.1-1.4: Core/shell particle Sample 1: Opacity reducer:

Lubricant (60:35:5) (ratio based on dried weight)

Comparative Layer A: Core/shell particle Sample 1: Lubricant (95:5) (ratio based on dried weight)

TABLE 1.1

| Layer Formulations: solids: 27% | | | | | | |
|---|---|---|---|---|---|---|
| % solids | | Comp. A Parts | 1.1 Parts | 1.2 Parts | 1.3 Parts | 1.4 Parts |
| 32.73 | Sample 1 | 95.0 | 60.0 | 60.0 | 60.0 | 60.0 |
| 27.7 | Crodamide ™SVF | | 35.0 | | | |
| 50 | KS-235 | | | 35.0 | | |
| 42.1 | HS-2046 | | | | 35.0 | |
| 15.6 | BON | | | | | 35.0 |
| 35.6 | Lubricant | 5.0 | 5.0 | 5.0 | 5.0 | 5.0 |
| | Total parts | 100.0 | 100.0 | 100.0 | 100.0 | 100.0 |
| Wt(g) | Sample 1 | 78.4 | 49.5 | 49.5 | 49.5 | 43.4 |
| | Crodamide ™SVF | 0.0 | 34.1 | 0.0 | 0.0 | 0.0 |
| | KS-235 | 0.0 | 0.0 | 18.9 | 0.0 | 0.0 |
| | HS-2046 | 0.0 | 0.0 | 0.0 | 22.4 | 0.0 |
| | BON | 0.0 | 0.0 | 0.0 | 0.0 | 53.2 |
| | Lubricant | 3.8 | 3.8 | 3.8 | 3.8 | 3.4 |
| | Water | 17.8 | 12.6 | 27.8 | 24.3 | 0 |

Note:
Crodamide ™ SVF is a product of Croda Universal Ltd.

On a 75 g/m$^2$ A4 paper was coated a black ink layer with an optical density of ca. 1.3 au. A Comparative A layer or a layer selected from Layers 1.1-1.4 was coated on top, the coat weights are given in Table 1.2. Before printing, the layer was opaque, it provided hiding for the underlying black layer, and the whole substrate appeared white. During printing, the polymeric particles including a void are believed to have collapsed in the area where the heat and pressure was applied by the thermal head, and the collapsed portions of the layer became transparent showing the underlying black color where it was printed. Optical density was measured with a hand-held optical densitometer.

TABLE 1.2

| Printing evaluation of recording material | | | | | |
|---|---|---|---|---|---|
| | | Opacity | Coat | Optical Density | |
| Layer | Opacity Reducer | reducer types | Weight (gsm) | 0.25 mJ/dot | 0.5 mJ/dot |
| A | none | na | 7.77 | 0.21 | 0.62 |
| 1.1 | 35% Crodamide ™SVF | Stearamide | 7.63 | 0.49 | 1.21 |
| 1.2 | 35% KS-235 | 1,2-diphenyloxy-ethane | 7.80 | 0.57 | 1.18 |
| 1.3 | 35% HS-2046 | Dibenzyl Oxalate | 7.85 | 0.62 | 1.23 |
| 1.4 | 35% BON | Benzyl 2-Naphthyl ether | 7.93 | 0.48 | 1.08 |

Opacity reducers (in Layers 1.1-1.4) provided improved optical density relative to the opacity reducer-free Comparative Layer A.

EXAMPLE 2

Preparation and Evaluation of Layer of Recording Material Including Opacity Reducer Layer Formulation 2.1: Core/shell particle Sample 2: Binder: Opacity reducer:

Lubricant (48:12:35:5) (ratio based on dried weight)

Comparative Layer B: Core/shell particle Sample 2: Binder:Lubricant (75:20:5) (ratio based on dried weight)

TABLE 2.1

| Layer Formulation: solids: 27% | | | |
|---|---|---|---|
| % solids | | Comp. B Parts | 2.1 Parts |
| 27.19 | Sample 2 | 75.0 | 48.0 |
| 27.7 | Crodamide ™SVF | | 35.0 |
| 50 | RHOPLEX ™ P-308 | 20.0 | 12.0 |
| 35.6 | Lubricant | 5.0 | 5.0 |
| | Total parts | 100.0 | 100.0 |
| Wt(g) | Sample 2 | 74.5 | 47.7 |
| | ML-260 | 0.0 | 0.0 |
| | ME-27720 | 0.0 | 0.0 |
| | Crodamide ™SVF | 0.0 | 34.1 |
| | P-308 | 10.8 | 6.5 |
| | Lubricant | 3.8 | 3.8 |
| | Water | 10.9 | 7.9 |

Recording materials were evaluated as in Example 1.

TABLE 2.2

| Printing evaluation of recording material | | | | | |
|---|---|---|---|---|---|
| | | | | Optical Density | |
| Layer | Opacity reducer | Opacity reducer type | Coat Weight (gsm) | 0.25 mJ/dot | 0.5 mJ/dot |
| Comp. B | none | none | 7.65 | 0.24 | 0.44 |
| 2.1 | 35% Crodamide ™SVF | Stear-amide | 7.44 | 0.25 | 0.80 |

The opacity reducer containing layer 2.1 provided improved optical density relative to the opacity reducer-free Comparative Layer B. The effect was more prominent for high energy printing (0.5 mJ/dot).

EXAMPLE 3

Preparation and Evaluation of Layer of Recording Material Including Opacity Reducer Layer Formulation 3.1: Core/shell particle Sample 3: Binder: Opacity reducer: PVOH: Leucophor™ UO: Lubricant (34.2:6.8:30.0:3.6:0.4:25.0) (ratio based on dried weight)

Comparative Layer C: Core/shell particle Sample 2: Binder: PVOH:Leucophor™ UO: Lubricant (64.2:6.8:3.6:0.4:25.0) (ratio based on dried weight)

TABLE 3.1

Layer Formulation: solids: 27%

| % solids | | Comp. C Parts | 3.1 Parts | 3.2 Parts |
|---|---|---|---|---|
| 30.4 | Sample 3 | 64.2 | 34.2 | 34.2 |
| 50.0 | KS-235 | | 30.0 | |
| 30.0 | TMP | | | 30.0 |
| 50.0 | Rhoplex ™ P-308 | 6.8 | 6.8 | 6.8 |
| 10.0 | PVOH | 3.6 | 3.6 | 3.6 |
| 24.2 | Leucophor ™ UO | 0.4 | 0.4 | 0.4 |
| 50.3 | Lubricant | 25.0 | 25.0 | 25.0 |
| | Total parts | 100.0 | 100.0 | 100.0 |
| Wt(g) | Sample 3 | 29.58 | 15.76 | 15.76 |
| | KS-235 | | 8.42 | |
| | TMP | | | 14.00 |
| | Rhoplex ™ P-308 | 1.89 | 1.89 | 1.89 |
| | PVOH | 5.04 | 5.04 | 5.04 |
| | Leucophor ™ UO | 0.23 | 0.23 | 0.23 |
| | Lubricant | 6.96 | 6.96 | 6.96 |
| | Water | 6.30 | 11.70 | 6.12 |

PVOH is poly(vinyl alcohol), Mowiol ™ 4-98.
Leucophor ™ UO is an optical brightener.

On a 75 g/m$^2$ A4 paper was coated a blue ink layer with an optical density of ca. 1.2 au. A Comparative C layer or a layer selected from Layers 3.1-3.2 was coated on top, the coat weights are given in Table 3.2. Before printing, the layer was opaque, it provided hiding for the underlying blue layer, and the whole substrate appeared white. During printing, the polymeric particles including a void are believed to have collapsed in the area where the heat and pressure was applied by the thermal head, and the collapsed portions of the layer became transparent showing the underlying blue color where it was printed. Optical density was measured with a hand-held optical densitometer.

TABLE 3.2

Printing evaluation of recording material

| Layer | Opacity reducer | Opacity reducer type | Coat Weight (gsm) | Optical Density 0.25 mJ/dot | Optical Density 0.5 mJ/dot |
|---|---|---|---|---|---|
| Comp. C | None | None | 5.67 | 0.49 | 1.00 |
| 3.1 | 30% KS-235 | 1,2 Diphenyloxy-ethane | 7.63 | 0.83 | 1.20 |
| 3.2 | 30% TMP | Trimethylol-propane | 8.93 | 0.58 | 1.23 |

The opacity reducer containing layers 3.1 and 3.2 provided improved optical density relative to the opacity reducer-free Comparative Layer C.

We claim:

1. A recording material comprising:

a) a support comprising at least one colored surface; and, disposed thereon, b) a layer comprising polymeric particles having a core/shell structure, said particles having an outer polymer shell having a calculated Tg of from 40° C. to 130° C., said particles comprising, when dry, at least one void; and from 1% to 90%, by weight based on the weight of said polymer particles, opacity reducer having a melting point of from 45° C. to 200° C., said opacity reducer selected from the group consisting of aromatic oxalic acid esters, aromatic ethylene glycol ethers, 1,2-diphenyloxyethane, dibenzyl oxalate, dibenzyl terephthalate, benzyl-biphenyl, benzyl-2-naphthyl ether, diphenyl sulfone, m-terphenyl, p-benzyloxybenzyl benzoate, cyclohexane dimethanol benzoate, p-toluenesulfonamide, o-toluenesulfonamide, 2,6-diisopropyl naphthalene, and 4,4-diisopropyl biphenyl.

2. The recording material of claim 1 wherein said colored surface has a surface roughness of less than 3.0 microns.

3. A recording material comprising:

a) a support; and, disposed thereon, b) a layer comprising a permanent colorant, polymeric particles having a core/shell structure, said particles having a polymer shell having a calculated Tg of from 40° C. to 130° C., said particles comprising, when dry, at least one void; and from 1% to 90%, by weight based on the weight of said polymer particles, opacity reducer having a melting point of from 45° C. to 200° C.

4. he recording material of claim 3 wherein said polymeric particles further comprise an outer second polymer shell having a calculated Tg of from −55° C. to 50° C.; wherein the calculated Tg of said outer polymer shell is lower that of said inner polymer shell.

5. A recording material comprising:

a) a support comprising at least one colored surface; and, disposed thereon, b) a layer comprising polymeric particles having a core/shell structure, said particles having a first polymer shell having a calculated Tg of from 40° C. to 130° C. and an outer second polymer shell having a calculated Tg of from −55° C. to 50° C.; wherein the calculated Tg of said outer polymer shell is lower that of said inner polymer shell, said particles comprising, when dry, at least one void; and from 1% to 90%, by weight based on the weight of said polymer particles, opacity reducer having a melting point of from 45° C. to 200° C.

6. The recording material of claim 5 wherein said colored surface has a surface roughness of less then 3.0 microns.

7. A method for providing an image comprising:

forming the recording material of any of claim 2, 3, 4, 5, or 6;

subjecting selected portions of said recording material to a physical agent selected from the group consisting of heat, pressure, and combinations thereof, sufficient to reduce the opacity of said selected portions.

8. A recording material comprising:

a) a support comprising at least one colored surface; and, disposed thereon, b) a layer comprising polymeric particles having a core/shell structure, said particles having an outer polymer shell having a calculated Tg of from 40° C. to 80° C., said particles comprising, when dry, at least one void; and from 1% to 90%, by weight based on the weight of said polymer particles, opacity reducer having a melting point of from 45° C. to 200° C., said opacity reducer selected from the group consisting of stearic acid amide, palmitic acid amide, aromatic oxalic acid ester, aromatic ethylene glycol ether, ethylene-bis-stearic acid amide, 1,2-diphenyloxyethane, dibenzyl oxalate, dibenzyl terephthalate, benzyl-biphenyl, benzyl-2-naphthyl ether, diphenyl sulfone, m-terphenyl, p-benzyloxybenzyl benzoate, cyclohexane dimethanol benzoate, p-toluenesulfonamide, o-toluenesulfonamide, 2,6-diisopropyl naphthaline, 4,4-diisopropyl biphenyl, and erucamide.

* * * * *